US005108051A

United States Patent [19]

Montet et al.

[11] Patent Number: 5,108,051

[45] Date of Patent: Apr. 28, 1992

[54] DEPLOYMENT MECHANISM OF A PROJECTILE FIN

[75] Inventors: Evelyne Montet; Bernard Masson, both of Bourges; Eric Chotet, Vignoux; Patrick A. G. Dauvergne, Levet; André Blin, Mehun Sur Yevre; Alain Bonnet, Bourges; Roger C. Crepin, Ville D'Avray, all of France

[73] Assignee: Etat Francais represente par le Delegue General pour l'Armement, Paris Armees, France

[21] Appl. No.: 274,904

[22] Filed: Nov. 22, 1988

[30] Foreign Application Priority Data

Nov. 26, 1987 [FR] France ..... 87 16389

[51] Int. Cl.[5] ..... F42B 10/14

[52] U.S. Cl. ..... 244/3.28; 244/329

[58] Field of Search ..... 244/3.27, 3.28, 3.29, 244/49

[56] References Cited

U.S. PATENT DOCUMENTS

| | | | |
|---|---|---|---|
| 2,402,468 | 6/1946 | Thompson | 244/49 |
| 2,572,421 | 10/1951 | Abel, Jr. | 244/49 |
| 3,063,375 | 11/1962 | Hawley et al. | 244/3.28 |
| 3,098,445 | 7/1963 | Jackson | 244/3.28 |
| 3,127,838 | 4/1964 | Moratti et al. | 244/3.28 |
| 4,323,208 | 4/1982 | Ball | 244/328 |
| 4,592,525 | 6/1986 | Madderra et al. | 244/3.28 |
| 4,709,877 | 12/1987 | Goulding | 244/3.28 |
| 4,869,442 | 9/1989 | Miller | 244/3.28 |

FOREIGN PATENT DOCUMENTS

| | | | |
|---|---|---|---|
| 13096 | 7/1980 | European Pat. Off. | 244/49 |
| 251890 | 1/1988 | European Pat. Off. | 244/49 |

*Primary Examiner*—Michael J. Carone

*Attorney, Agent, or Firm*—Parkhurst Wendel & Rossi

[57] ABSTRACT

A mechanism is described for attaching a fin to a projectile and for deploying the fin from a stowed position to a deployed position. In the stowed position the fin is parallel to a centrally located axis which extends from the front portion to the rear portion of the projectile. A mounting which is disposed in a bearing and to which the fin is attached permits pivoting of the fin and deployment of the fin in two phases. During the first phase the fin moves from the stowed position to a semideployed positions by rotation in the bearing about an axis normal to the projectile's centrally located axis. During the second phase the fin moves from the semideployed position to the deployed position by pivoting relative to the mounting.

19 Claims, 5 Drawing Sheets

DEPLOYMENT MECHANISM OF A PROJECTILE FIN

BRIEF DESCRIPTION

The invention is in the technical field of deployment mechanisms for the fins of projectiles.

The mechanism in accordance with the invention deploys a fin (2) between a start position in which its plane is substantially parallel to the axis of the projectile (1), and a deployed position, the fin being fixed to the projectile by a pivoting arrangement (11), a mechanism characterised by the pivoting arrangement being such that the movement of deployment comprises at least two phases;

a first phase in which the fin moves from the start position to a semi-deployed position by rotation on a first axis (5) which is perpendicular to the plane of the fin when the latter is in the start position and a second phase in which the fin moves from the semi-deployed position to the deployed position by rotation on a second axis (6) which is parallel to the plane of the fin.

Of application to deployment mechanisms for the guidance fins of projectiles.

The invention is in the field of deployment mechanisms for the fins of projectiles, and more particularly the steerable fins, that is which can pivot in the deployed position under the action of a servo motor on an axis substantially perpendicular to the axis of the projectile.

Deployable fins may have no more than a stabilising role on a projectile which has only a slow rotatory motion or none at all, or they may also have a steering role analogous to that of the control surfaces of an aeroplane; in this latter case they are controlled by a motor, itself governed by an electronic system, they can then serve to modify the trajectory of the projectile during its flight and therefore to correct possible aiming errors, or again, after a target has been detected, to guide the projectile automatically towards it.

The principal drawback of such fins is that to be effective they must be of substantial dimensions (the length of the fin is usually of the same order as the calibre), which makes it impossible to fire the projectile from a weapon of corresponding calibre. So for many years now various deployment mechanisms have been developed for fins, which might be steerable ones or more simply stabilisers, and the projectile bearing them could be a missile or rocket or even a sub-projectile carried by a gyro-stabilised carrier projectile of large calibre.

The U.S. Pat. No. 4,664,339 will be considered in particular. It describes a fin which is steerable in its deployed position by the action of a motor and which in the start position is arranged substantially parallel to the axis of the projectile. This fin is moved to the deployed position by the effect of aerodynamic forces which act on it after a locking pin has been released, the fin being set in motion by a spring.

This start position is particularly advantageous because it does not reduce the useful volume of the projectile; a solution of this type therefore offers a clear improvement as compared to the deployable fins previously proposed which were arranged in the interior of the projectile in the start position (see for example U.S. Pat. No. 4,659,037).

But this mechanism has drawbacks nevertheless. Thus at the moment of their deployment, the fins begin by opposing their largest surface to the airflow; and the leading edge of the fin, a much smaller surface, is only oriented in the direction of this flow at the end of the deploying movement. In consequence the projectile is slowed down and risks being destabilised, all the more so because the asymmetrical effects as regards the deploying movements of the fins will be amplified by the magnitude of the forces acting on them. The risk of destabilisation will be all the more critical if the projectile is gyro-stabilised at the start and the deployment of the fins is intended to enable it to change to stabilisation by fins.

Lastly, and especially in the case of a sub-projectile released into its trajectory by a carrier projectile, it is necessary to wait until the projectile's speed of rotation is below a certain level before inducing the deployment of the guide fins, this is in order to lessen the stresses to which the fins are subjected. The use of a control latch, proposed in U.S. Pat. No. 4,664,339 fulfills that function but complicates series production of the projectile and introduces a further cause of malfunction.

The aim of the present invention is to put forward a deployment mechanism for fins fixed to a projectile, a mechanism ensuring that the opening causes the minimum of aerodynamic disturbance as well as the minimum of stresses on the fins, and which as the same time does not reduce the useful internal volume of the projectile.

When applied to fins which are to perform a steering function, the invention offers a means of total control over their movements of deployment and over the instant of starting these movements, without requiring a supplementary locking mechanism.

Thus the aim of the invention is a mechanism to deploy a projectile's fin between a start position in which the plane of the fin is substantially parallel to the axis of the projectile and a deployed position, the fin being fixed to the projectile by a pivoting arrangement, a mechanism characterised by the pivoting arrangement being such that the movement comprises at least two phases:

a first phase in which the fin moves from the start position to a semi-deployed position, this movement being carried out by rotation on a first axis which is perpendicular to the plane of the fin when the latter is in the start position and a second phase in which the fin moves from the semi-deployed position to the deployed position, by rotation on a second axis which is parallel to the plane of the fin.

In accordance with certain principal characteristics, the fin is moved by an actuator during all or part of the first phase of the movement of deployment, and it is immobilised in relation to the projectile by a locking device when in the start position.

According to a particular mode of application of the invention, the fin in the deployed position can pivot on the first axis driven by a servo motor, and this motor forms the actuator and/or the locking device.

In a preferred embodiment of the invention, the fin on the one hand is fixed to a mounting, itself fixed in relation to the internal race of a bearing, the external race of which is fixed in relation to the projectile, and the motor on the other hand is fixed in relation to the projectile and controls the rotation of the mounting through a coupling joint.

During the second phase of the deployment movement it will be possible for the fin to be moved by aerodynamic forces; in this case it can have on it a slug, which will circulate during the first phase of the deployment movement in a circular groove fixed in relation to the projectile, and the second phase will commence when the slug is passing an opening in this slot.

Finally the mounting will include a bolt which immobilises the fin in relation to the mounting in the deployed position.

Other advantages of the invention will be evident on reading the description below of a particular embodiment. The description is to be read together with the drawings attached in which:

FIG. 5 being a view of FIG. 4 following the direction Z.

Returning to FIGS. 1 to 3, a projectile 1 has at its rear four fins 2 (shown diagrammatically as parallelepipeds to simplify the description) intended to perform both a stabilising function and a steering function; these fins are fixed to the projectile by the pivoting arrangements 11, which will be described in detail below.

The projectile is fired by a weapon, not shown, and is gyro-stabilised during the first part of its trajectory, it thus includes devices known and not shown here (such as a rotating band) such that they impart a rotatory motion to it during its course inside the weapon.

This rotating band may be fixed to the projectile itself or to a cylindrical component which is immobile in relation to the projectile and is jettisoned in flight by explosive means (see for example patent W081/00908).

Figure 1:
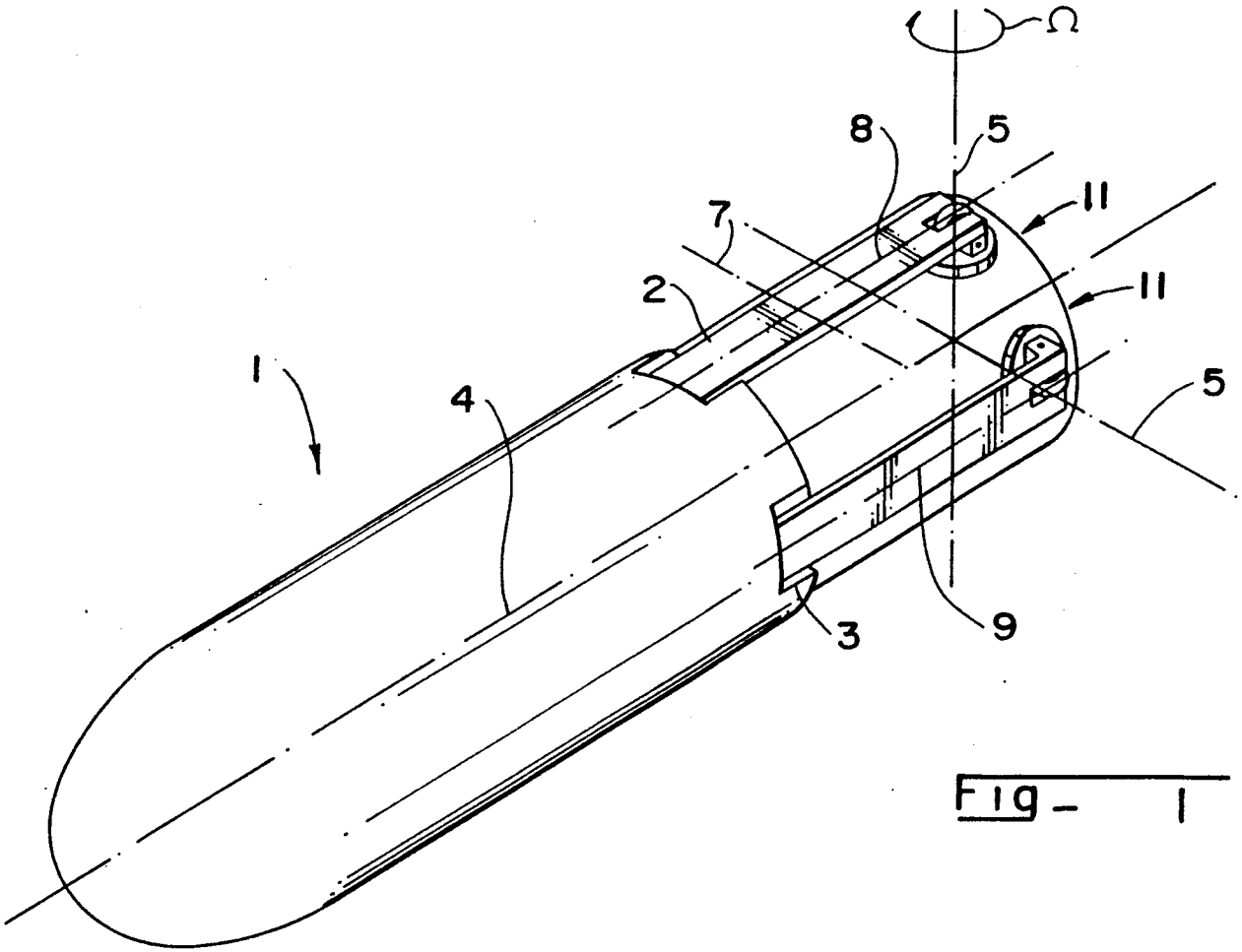
FIG. 1 shows a diagram of a projectile equipped with fins, these being in the start position.

The fins 2 are shown in FIG. 1 in the start position. They are immobilised in relation to the projectile by a locking device which will be described below. In the start position the plane of the fin, defined by an axis 8 which indicates the fin's main direction and an axis 7 at right angles to the preceding one, is substantially parallel to the axis 4 of the projectile. This position is analogous to the start position described in U.S. Pat. No. 4,664,339. The forward end of each fin rests in a recess 3 of the body of the projectile 1.

Figure 2:
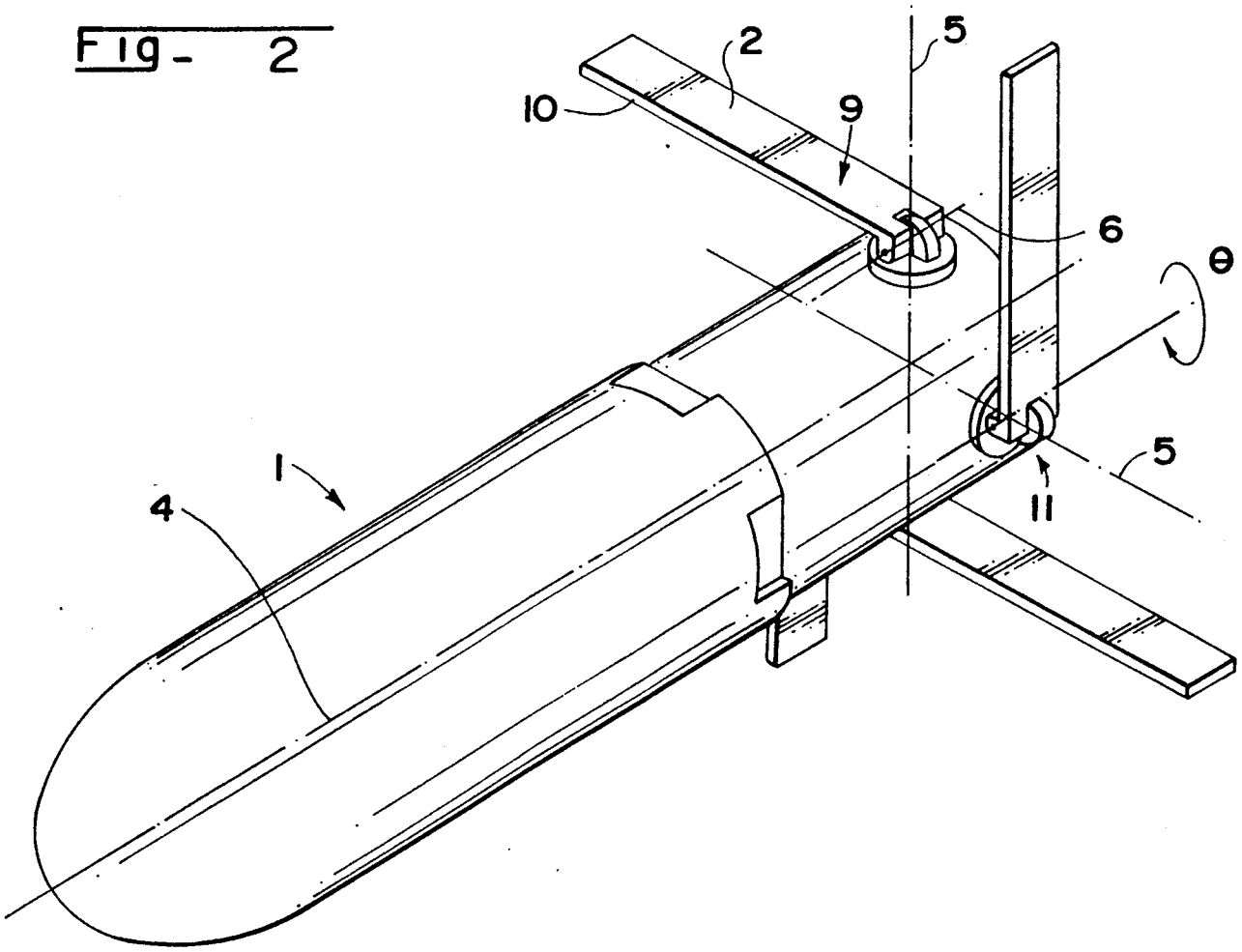
FIGS. 2 and 3 are similar to the preceding one and show the fins in, respectively, the semi-deployed and the deployed position.

FIG. 2 shows the projectile with its fins semi-deployed. The passage from the start position to the semi-deployed position, which constitutes a first phase of the movement of deployment, has been brought about by rotation of each fin in the direction $\Omega$ (see FIG. 1) about a first axis substantially perpendicular to the axis of the projectile and therefore to the plane of the fin when it is in the start position. This rotation has been produced during all or part of the movement by an actuator which will be described later.

Figure 3:
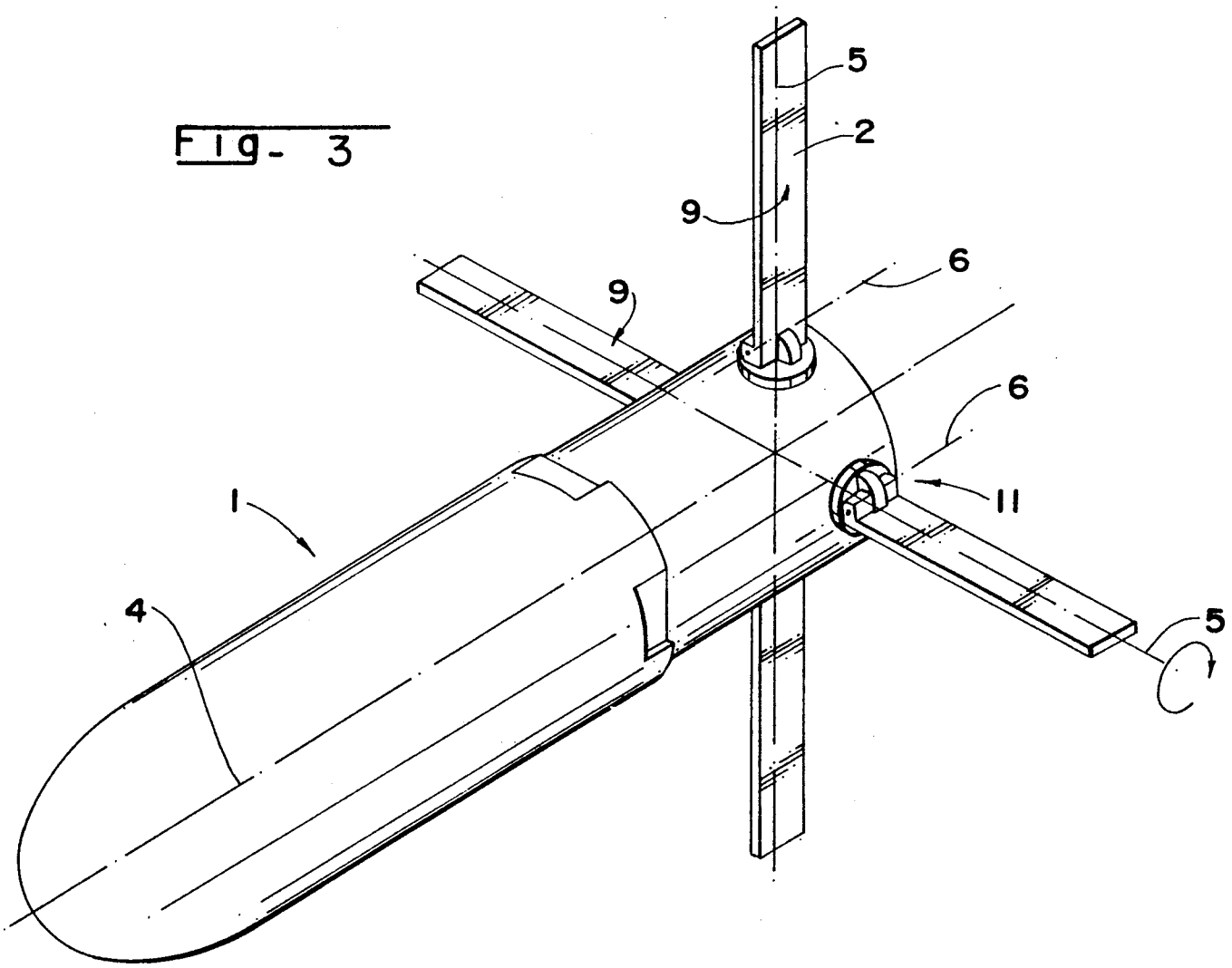

FIG. 3 shows the projectile with the fins fully deployed. The passage from the semi-deployed to the fully deployed position (second phase of the movement of deployment), by rotation of each fin in the direction $\theta$, abut a second axis 6, which is parallel to the plane of the fin.

During both the first and second phases, the rotatory movements are such that only the leading edge 10 of each fin is offered in the direction of the airflow.

The increase in the projectile's drag which results from the deployment of its fins is markedly lower than that obtained with the opening mechanism described in U.S. Pat. No. 4,664,339. Compared with this latter mechanism and thanks to the invention, it can be reckoned that the increase in drag is reduced substantially in the proportion of the total surface of the leading edges 10 to the total surface of the aerofoils 9, which gives a reduction of the order of 10.

The stresses to which the fins are subjected are reduced likewise in substantially the same proportion, which allows the mass of the fins to be reduced to the benefit of the useful load of the projectile and shocks and establishing asymmetrical effects are also reduced thereby.

Finally the inertia of each fin being greater in the direction 7 than in the normal direction n the plane of the fin (the ratio of the inertias is of the order of 60), the fins are less susceptible to bending deformations induced by the aerodynamic stresses. This augmented rigidity of the fins results in an increase in their natural frequencies of vibration which, together with the notable reduction in the stresses to which they are subjected, makes it possible to guarantee a regular deploying movement of each fin, which reduces the risks of the projectile being destabilised.

Thus the principal advantage of the invention is to offer a fin deployment mechanism which induces the minimum disturbance in the trajectory of the projectile.

In the particular case of a projectile which is gyro-stabilised during the first part of its trajectory, it can be noted that this kind of deployment motion also makes it possible to reduce the speed of rotation of the projectile at the moment of changing from gyro-stabilisation to stabilisation by fins. But the particular advantage contributed by the invention is that this braking of the rotation is very progressive in this case; in fact the part of the aerofoil which protrudes relative to the projectile grows continuously during the whole of the first phase of the deployment motion until it reaches its maximum value in the semi-deployed position shown in FIG. 2. As this progressively increasing braking effect on the rotation coincides with a progressive increase in the span of the fins and in their orientation in relation to the projectile, and therefore in the static margin (the distance between the seat of the aerodynamic stresses acting on the projectile and the latter's center of gravity), it is a steadying factor during the change from gyro-stabilisation to stabilisation by fins; the risks of disturbance of the projectile's trajectory are therefore reduced still further thanks to this particular feature of the invention.

Figure 4:
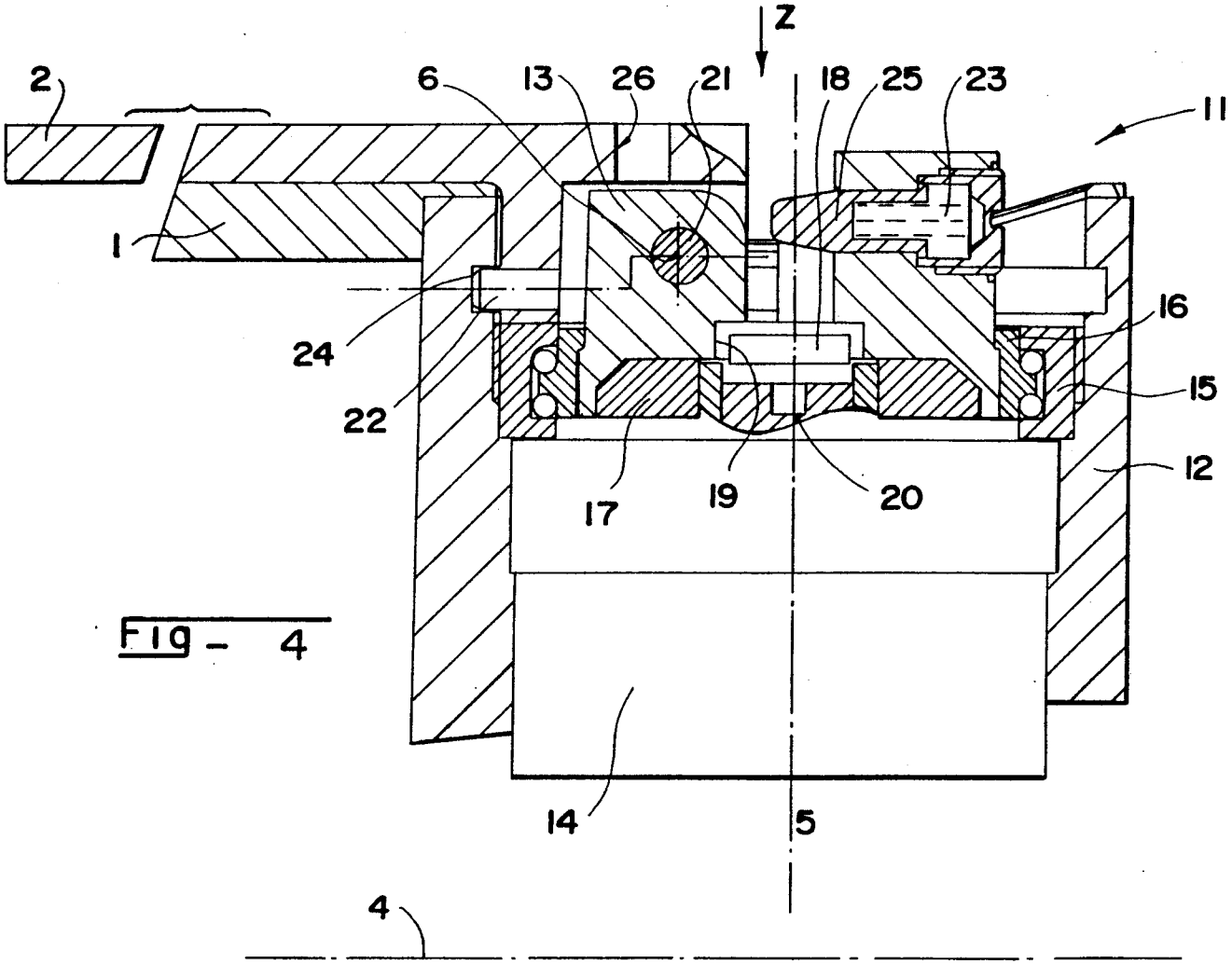
FIGS. 4 and 5 show a particular embodiment of a deployment mechanism in accordance with the invention.
Figure 5:
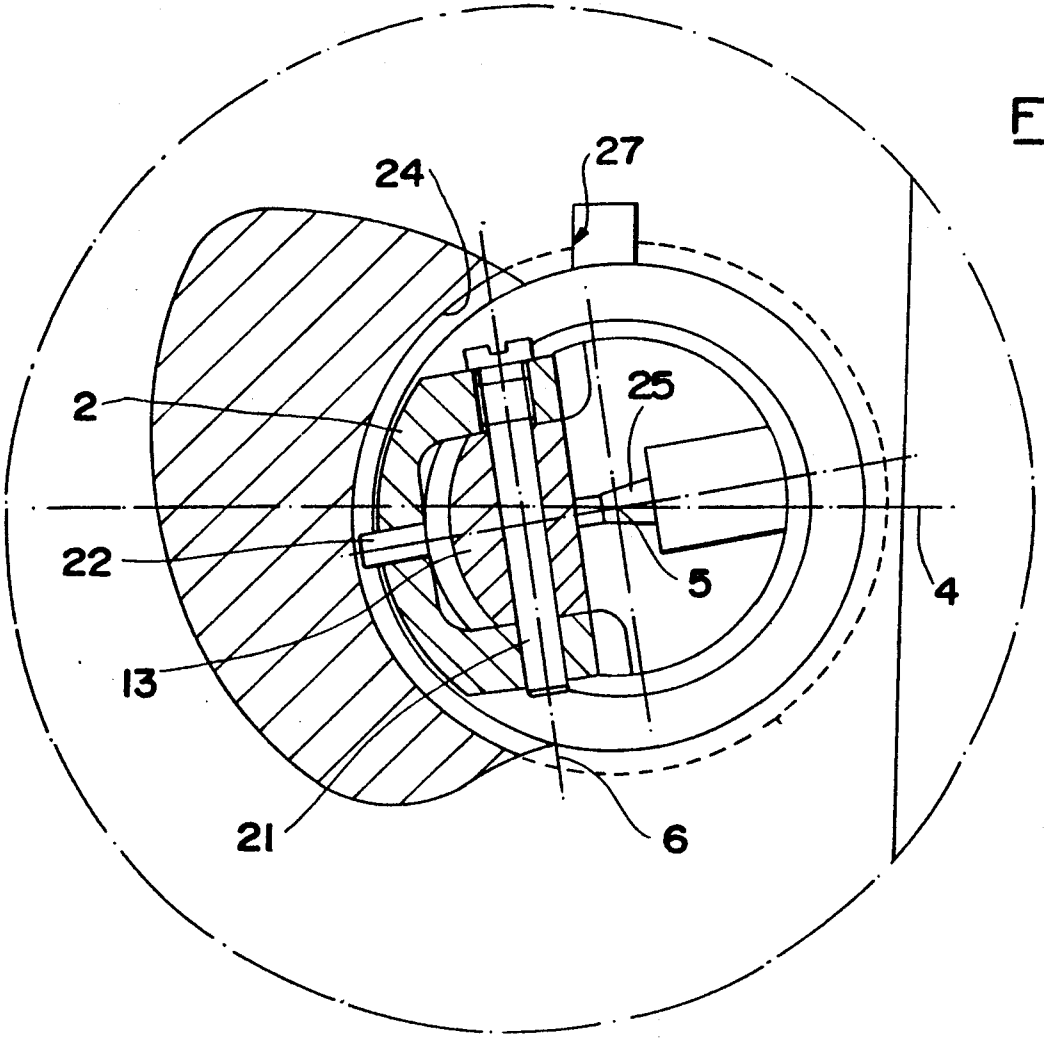

FIGS. 4 and 5 show the detail of the pivoting arrangement 11, the locking device and the actuator, which produce the two phases of the deployment movement described earlier, in this particular embodiment of the mechanism in accordance with the invention.

Each fin 2 is fixed to a mounting 13 by a pivot 21 which represents the second axis 6. The assembly of the fin on the mounting is of the fork and lug type, one extremity of the fin forming the fork and the mounting 13 forming the lug. This type of arrangement allows better guiding of the fin during its deployment motion. The fin is shown here in its start position with its plane parallel to the axis 4 of the projectile 1. The mounting 13 is fixed in relation to the internal race 16 of a bearing with two rows of angular contact ball-bearings. The external race 15 of this bearing is fixed by a screw thread to a casing 12, itself fixed to the projectile 1. The assembled mounting and bearing thus form the pivoting arrangement 11. A motor 14, here an electric reduction motor is also fixed to the casing 12; in this particular embodiment it is joined to the casing in translation by a shoulder of the latter and by the external race 15 of the bearing, and as regards rotation by slugs which are not shown. On the upper part of its shaft the motor 14 ha a groove 20 and the mounting 13 has a groove 19; these two grooves with a linking part 18 form a coupling joint, preferably homokinetic, such as, here, as Oldham coupling, which enables the motor 14 to drive the mounting 13, carrying the fin 2 in rotation about the first axis 5.

The coupling joint provides tolerance for a poor axial alignment in the assembly of the mounting and the motor, but it also insulates the latter from vibrations which might be transmitted to it by the fin. The joint likewise insulates the motor from the aerodynamic stresses which the fin will therefore transmit directly to the projectile 1 through the mounting and the bearing.

The fin carries a slug 22 one end of which lodges in a circular channel n the casing. This circular groove ends in an opening 27 (see FIG. 5) the use of which will be explained below. The mounting 13 also includes a bolt 23 formed by a finger 25 which slides against the action of a return spring and is intended to enter a recess 26 in the fin 2 with the purpose of locking the latter in the deployed position at the end of the second phase of the motion of deployment.

Finally a sensor 17 of known type fixed to the mounting 13 will keep an electronic pilot unit, not shown, informed of the angle of the fin 2 in relation to the first axis 5.

Thus in this particular embodiment the motor, whose main function is to guide the projectile by causing the deployed fin to pivot about the first axis 5, is also the actuator which sets off the first phase of the fin's motion of deployment: its movement from the start position to the semi-deployed position.

As the reduction mechanism in it is irreversible, the motor also acts as the locking device for the fin in its start position.

An arrangement of this kind offers a number of advantages:

It avoids the use of supplementary devices of the latch type (see U.S. Pat. No. 4,664,339) to immobilise the fin in the start position; this eliminates a risk of failure by simplifying the deployment control assembly.

It provides mastery of the kinematics of the fist phase of the movement of opening, and this results in complete symmetry of the opening motions of the different fins. The start of the opening is under complete command and responds to the controls of the motors; the speeds and positions of the fins can be controlled by an electronic unit, itself known, which will act individually on the control voltages of the different motors in accordance with the information furnished by the sensors.

The control of the motors thus executes the first phase of the deployment movement, which as has been seen earlier will bring about a progressive braking of the projectile's rotation; (but it is also possible to use other kinds of fins of known type, such as those described in patent W081/00908, in order to bring about braking of the rotation, the deployment of the guidance fins being triggered in that case only when the speed of rotation has fallen below a certain value, of the order of 20 to 30 revolutions per second); when the fins are in the position shown in FIG. 2, the slug 22, which has travelled during the first phase of the deployment movement in the channel 24 and has thus maintained the fin in the plane defined by the axes 7 and 8 is then opposite the opening 27. The aerodynamic forces acting on the fin are sufficient to cause it to pivot about the second axis 6 and thus to complete the second phase of the deployment movement, to the point at which the fin is locked; the motor will thereafter perform its steering function by causing the deployed fin to pivot about the first axis.

It is clear that it would be possible, still within the limits of the invention, to replace the slug by a protuberance of the fin itself, or by any other technical equivalent which would maintain the fin, during the first phase of the deployment movement, in the plane defined by the axes 7 and 8.

Other variants are possible within the limits of the invention. Other types of motor are conceivable to fulfil both the function of actuating the deployment movement of the fin and the function of steering the projectile; such as a gas-driven motor supplied from a gas store or a gas generator started by an explosive cartridge. The invention can be applied to fins which are stabilisers only and do not therefore fulfil any guidance function. There will then be a pivoting arrangement 11 of the type of that described earlier, but in the absence of the motor an actuator will be required, for instance a mechanical one, such as a spring giving an impulse to the fin, on which aerodynamic forces then act to complete the movement of deployment; and it may be necessary in some cases to provide for a locking device such as that described in the U.S. Pat. No. 4,664,339.

It is also possible to combine this last-mentioned method of locking and opening the fins with the use of an electric guidance motor; it will be necessary in that case to provide a means of declutching the motor during the first phase of the movement of deployment.

We claim:

1. A mechanism for attaching a fin to a projectile and for deploying said fin from a stowed position to a deployed position, said fin in the stowed position being parallel to a centrally located axis extending from a front portion to a rear portion of said projectile, said fin in the deployed position being normal to said centrally located axis, wherein said mechanism comprises:

a mounting disposed in a bearing, said fin being attached to said mounting and being pivotable relative to said mounting, and said mounting being rotatable in said bearing about an axis normal to said centrally located axis, said mechanism for deploying the fin in two phases:

a first phase in which said fin moves from said stowed position to a semi-deployed position by rotation of said mounting in said bearing about said axis normal to said centrally located axis; and a second phase in which said fin moves from said semi-deployed position to a fully deployed position by pivoting relative to said mounting.

2. The mechanism of claim 1, wherein said fin is moved by an actuator during the first phase of deployment.

3. The mechanism of claim 1, wherein said fin in the stowed position is immobilized in relation to said projectile by a locking device.

4. The mechanism of claim 1, wherein said fin in said semi-deployed position and said fully deployed position is able to rotate about said axis normal to said centrally located axis driven by a servo motor.

5. The mechanism of claim 1, wherein said fin is moved by aerodynamic forces during the second phase of deployment.

6. A mechanism for attaching a fin to a projectile and for deploying said fin from a stowed position to a deployed position, said fin in the stowed position being parallel to a centrally located axis extending from a front portion to a rear portion of said projectile, said fin in the deployed position being normal to said centrally located axis, wherein said mechanism comprises:

a mounting disposed in a bearing, said fin being attached to said mounting and being pivotable relative to said mounting, and said mounting being rotatable in said bearing about an axis normal to said centrally located axis, and said mounting is fixed in relation to an internal race of said bearing an said bearing is fixed to said projectile by an exterior race of said bearing;

said mechanism for deploying the fin in two phases:

a first phase in which said fin moves from said stowed position to a semi-deployed position by rotation of said mounting in said bearing about said axis normal to said centrally located axis; and a second phase in which said fin moves from said semi-deployed position to a fully deployed position by pivoting relative to said mounting;

wherein said fin in said semi-deployed position and said fully deployed position is able to rotate about said axis normal to said centrally located axis driven by a servo motor.

7. The mechanism of claim 6, wherein the servo motor is an actuator.

8. The mechanism of claim 6, wherein the servo motor is fixed in relation to said projectile and controls the rotation of said mounting through a coupling joint.

9. The mechanism of claim 6, wherein said fin in the stowed position is immobilized in relation to said projectile by a locking device.

10. The mechanism of claim 6, wherein said fin is moved by aerodynamic forces during the second phase of deployment.

11. The mechanism of claim 10, wherein said fin bears a slug which travels during the first phase of deployment in a circular slot which is fixed in relation to said projectile, which slug upon reaching said semideployed position passes opposite an opening, allowing said fin to pivot relative to said mounting to said fully deployed position.

12. The mechanism of claim 6, wherein the mounting includes a bolt which immobilizes said fin in relation to said mounting when in the fully deployed position.

13. A mechanism for attaching a fin to a projectile and for deploying said fin from a stowed position to a deployed position, said fin in the stowed position being parallel to a centrally located axis extending from a front portion to a rear portion of said projectile, said fin in the deployed position being normal to said centrally located axis, wherein said mechanism comprises:

a mounting disposed in a bearing, said fin being attached to said mounting and being pivotable relative to said mounting, and said mounting being rotatable in said bearing about an axis normal to said centrally located axis, said mechanism for deploying the fin in two phases:

a first phase in which said fin moves from said stowed position to a semi-deployed position by rotation of said mounting in said bearing about said axis normal to said centrally located axis; and a second phase in which said fin moves from said semi-deployed position to a fully deployed position by pivoting relative to said mounting;

wherein said fin bears a slug which travels during the first phase of deployment in a circular slot which is fixed in relation to said projectile, which slug upon reaching said semideployed position passes opposite an opening, allowing said fin to pivot relative to said mounting to said fully deployed position;

and wherein said fin is moved by aerodynamic forces during the second phase of deployment.

14. An airstream-deploying airfoil assembly for use in conjunction with a projectile of the type having a longitudinal axis and a radial surface; the assembly comprising:

an airfoil having one end free and one end affixed as a point of rotation;

a yoke positioned for rotation substantially in said radial surface; and a pivot pin attached to said affixed end of said airfoil and rotatably affixed to said yoke for rotation therein;

said airfoil being stowed in a position tangential to said radial surface and substantially parallel to said longitudinal axis and being first rotatable through about 90 degrees with said yoke in a plane tangential to said radial surface and thereafter rotatable through about 90 degrees with said pivot in a direction substantially perpendicular to said longitudinal axis.

15. The assembly recited in claim 14 further comprising means preventing rotation to said pivot pin until completion of rotation of said yoke.

16. The assembly recited in claim 14 further comprising means for locking said yoke after rotation thereof.

17. The assembly recited in claim 14 further comprising means for locking said pivot pin after rotation thereof.

18. A self-deployable wing for an artillery shell comprising:

means for first rotating the wing through about 90 degrees from a stowed position parallel to the shell in a plane tangential to the shell;

means for subsequently rotating the wing through about 90 degrees in a direction substantially perpendicular to the artillery shell;

means for preventing said subsequent rotating until completion of said first rotating; and means for locking said wing into its fully deployed position upon completion of said subsequent rotating.

19. The self-deployable wing recited in claim 18 wherein said first rotating means comprises a spring.

* * * * *